US007926399B2

(12) United States Patent
Huang et al.

(10) Patent No.: US 7,926,399 B2
(45) Date of Patent: Apr. 19, 2011

(54) PUNCH ASSEMBLY

(75) Inventors: Kuo-Jung Huang, Taipei Hsien (TW); Jian Luo, Shenzhen (CN); Fu-Shun Huang, Taipei Hsien (TW); Chun-Nan Ou, Taipei Hsien (TW); Chia-Hsiang Ou, Taipei Hsien (TW); Yi-Hua Liu, Shenzhen (CN); Shu-Wei Zhou, Shenzhen (CN)

(73) Assignees: Hong Fu Jin Precision Industry (ShenZhen) Co., Ltd., Shenzhen, Guangdong Province (CH); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 469 days.

(21) Appl. No.: 12/187,398

(22) Filed: Aug. 7, 2008

(65) Prior Publication Data

US 2009/0223032 A1 Sep. 10, 2009

(30) Foreign Application Priority Data

Mar. 7, 2008 (CN) ..... 2008 1 0300489

(51) Int. Cl.
*B26F 1/14* (2006.01)
*B21D 28/20* (2006.01)
*B21D 37/00* (2006.01)

(52) U.S. Cl. ..... 83/530; 72/442; 72/480; 72/453.13; 72/482.94; 83/686; 83/699.41; 83/698.91; 29/33 J; 29/36

(58) Field of Classification Search ..... 72/442, 72/437, 453.13, 472, 480, 482.94; 83/530, 83/552, 563, 686, 698.91, 699.11, 699.41; 29/33 J, 36
See application file for complete search history.

(56) References Cited

U.S. PATENT DOCUMENTS

| | | | | |
|---|---|---|---|---|
| 5,020,407 | A * | 6/1991 | Brinlee | 83/686 |
| 6,895,797 | B2 * | 5/2005 | Lowry et al. | 72/480 |
| 7,168,356 | B2 * | 1/2007 | Rosene et al. | 83/686 |
| 7,658,134 | B2 * | 2/2010 | Morgan | 83/530 |
| 7,823,434 | B2 * | 11/2010 | Lee et al. | 72/442 |

FOREIGN PATENT DOCUMENTS

| | | | |
|---|---|---|---|
| CN | 2827580 | Y | 10/2006 |
| CN | 2834728 | Y | 11/2006 |
| CN | 201033339 | Y | 3/2008 |
| TW | 200709003 | A | 3/2007 |

* cited by examiner

*Primary Examiner* — David B Jones
(74) *Attorney, Agent, or Firm* — Frank R. Niranjan

(57) ABSTRACT

A punching assembly includes a die base, a sleeve, an adjusting screw, a pull portion, a latching block, an elastic element, a fixing ring and a stop member. A top of the die base is received in the sleeve. The adjusting screw includes a contact end, a mounted end inserting into the sleeve and connecting to the top of the die base, and a latching portion located between the contact end and the mounted end. The pull portion is disposed around the sleeve. The latching block engages the latching portion. The elastic element is disposed around the adjusting screw, supporting the latching block. The fixing ring surrounding the adjusting screw is fixed on the sleeve. The stop member, contiguous with the fixing ring, prevents axial movement of the adjusting screw.

18 Claims, 10 Drawing Sheets

PUNCH ASSEMBLY

BACKGROUND

1. Field of the Invention

The present invention relates to punch presses, specifically to a punch used in a punch press.

2. Description of Related Art

Repeated use of a punch assembly in a punch press operation results in natural dulling and wear of the punch tip. Once the tip has become dull, the effectiveness of the punch assembly is reduced, thereby requiring the punch tip to be sharpened. Sharpening can be accomplished by grinding the end of the punch tip, which necessarily shortens the punch, requiring that the punch be adjustable to compensate for the ground away portion.

Generally, a length-adjusting device of a punch assembly includes an adjusting bolt, a nut, and at least one fixing screw for fixing the nut on the bolt. When the length of the punch assembly needs to be adjusted, the fixing screw is backed off the nut rotated. After adjustment, the fixing screw is reinserted. For such adjustment, a tool such as a screwdriver must be used. This process is both inconvenient and inefficient.

Therefore, a heretofore unaddressed need exists in the industry to address the described limitations.

SUMMARY

According to an exemplary embodiment of the present invention, a punching assembly comprises a die base comprising at least one pin thereon and a base adjusting device for adjusting a base level of the die base. The base adjusting device comprises a sleeve, an adjusting screw, a pull portion, a latching block, an elastic element, a fixing ring, and a stop member.

The sleeve comprises a first end defining at least one first guiding hole, a second end defining at least one second guiding hole, and a stage on an inner wall thereof. The die base is partially received in the sleeve, wherein the pin and the second guiding hole cooperatively allow the die base to move along the second guiding hole. The adjusting screw comprises a contact end and a mounting end received in the sleeve from the first end and connecting to the die base via screws, and a latching portion located between the contact end and the mounted end. The latching block is disposed around the adjusting screw and configured for engaging with the latching portion. The pull portion is fixed to the latching block through the first guiding hole, and moves along the first guiding hole together with the latching block. The elastic element is disposed around the adjusting screw with two ends respectively abutting against the latching block and the stage. The fixing ring is fixed on the sleeve and disposed around the adjusting screw, and contiguous with the contact end in a clearance fit. The stop member is fixed on the adjusting screw and contiguous with the fixing ring to prevent axial movement of the adjusting screw relative to the sleeve.

Other advantages and novel features will become more apparent from the following detailed description when taken in conjunction with the accompanying drawings, in which:

DETAILED DESCRIPTION OF THE EMBODIMENTS

Figure 1:
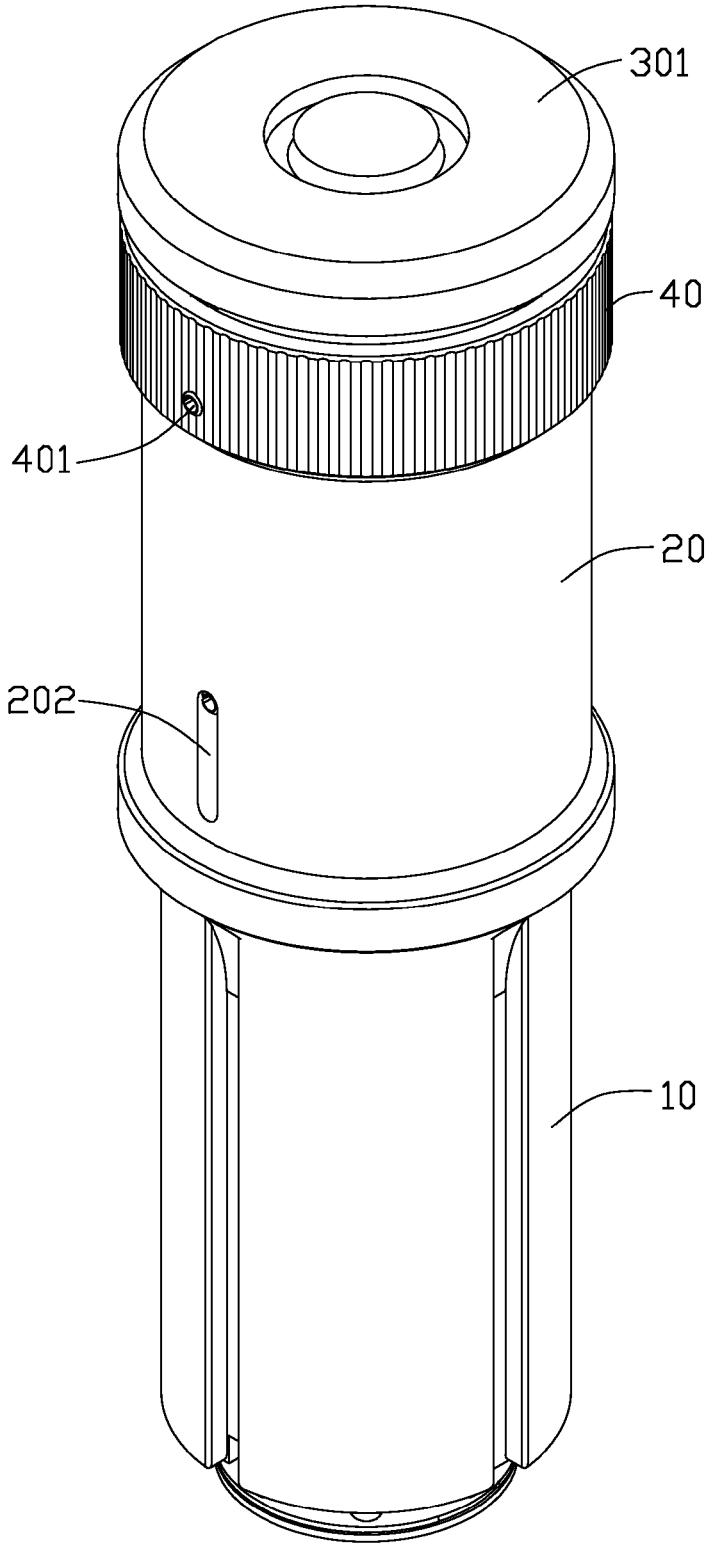
FIG. 1 is a perspective view of a punch assembly in accordance with an exemplary embodiment.
Figure 3:
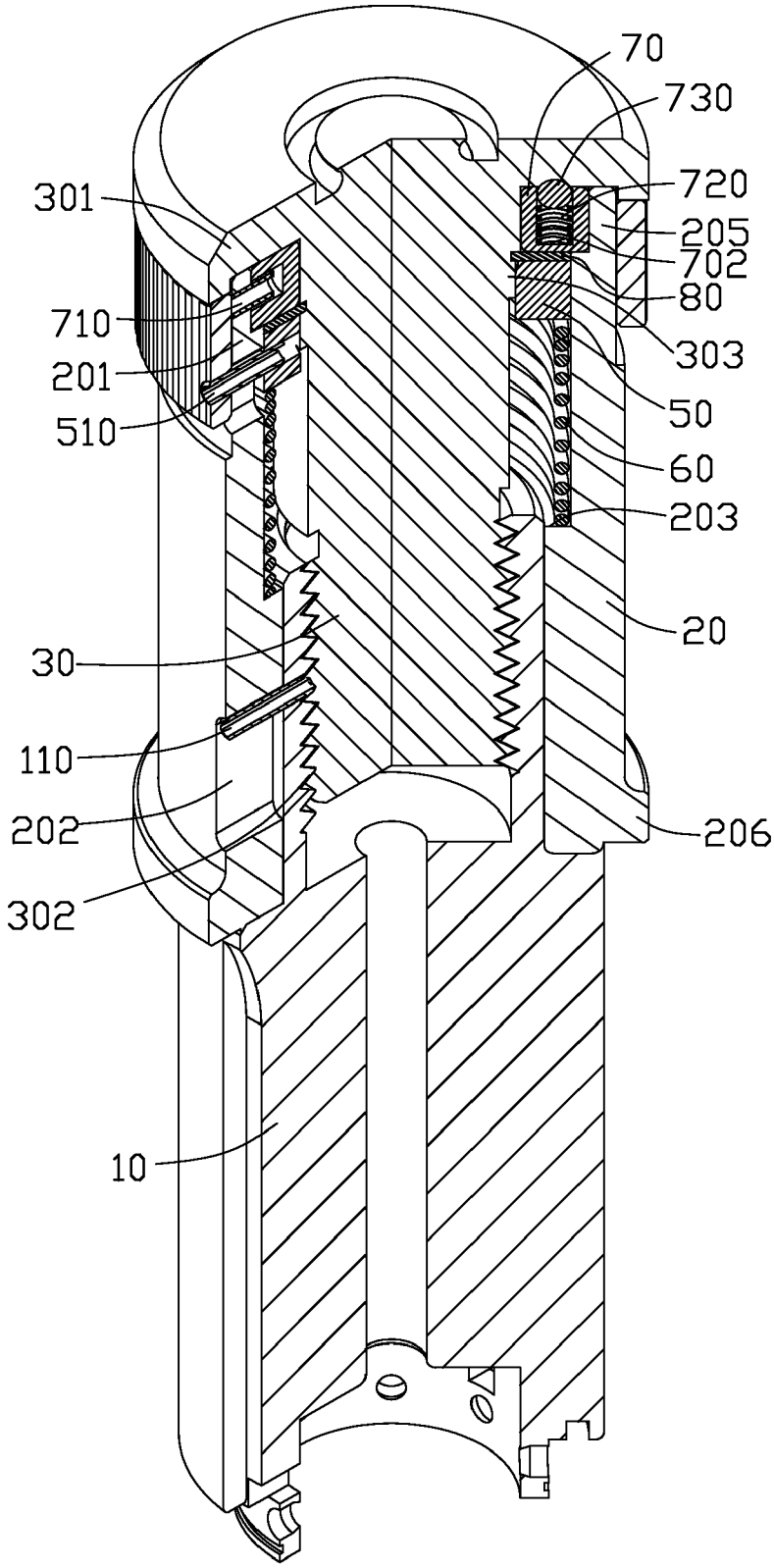
FIG. 3 is a cutaway view along an axis of the punch assembly in a locked state of FIG. 1.

Referring to FIG. 1 and FIG. 3, a punch assembly comprises a die base 10 and a base adjusting device. The base adjusting device comprises a sleeve 20, an adjusting screw 30 and a pull portion 40.

Figure 2:
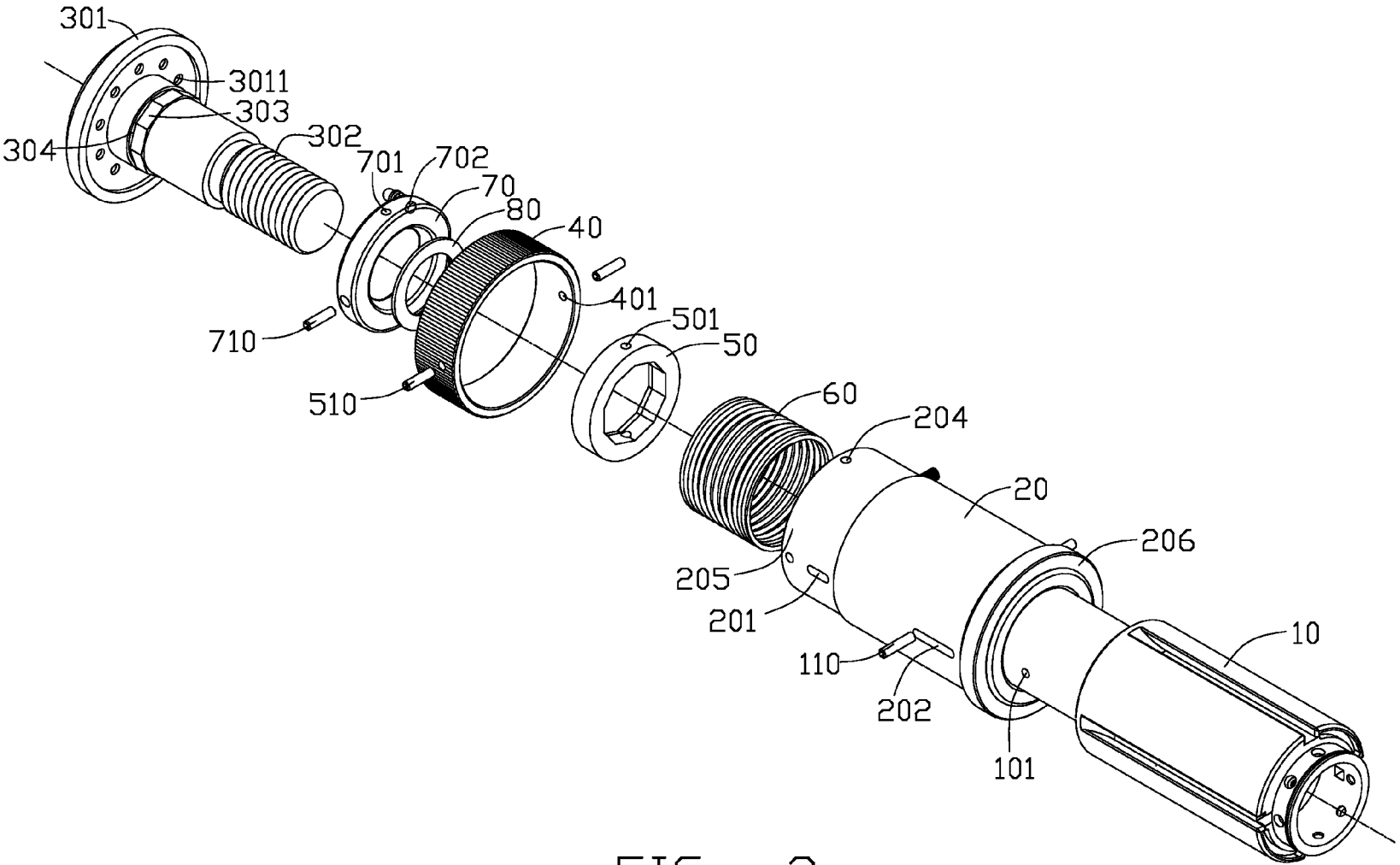
FIG. 2 is an exploded perspective view of the punch assembly of FIG. 1.

Referring to FIG. 2 and FIG. 3, the sleeve 20 comprises a first end 205 defining at least one first guiding hole 201 and a second end 206 defining at least one second guiding hole 202. The first end 205 also defines at least one first fixing hole 204 between the first guided hole 201 and an end face of the first end 205. The sleeve 20 includes a stage 203 on an inner wall thereof. The outer diameter of the second end 206 exceeds that of the die base 10.

The die base 10 is partially received in the sleeve 20, comprising at least one pin 110 thereon which communicates with the second guiding hole(s) 202 to cooperatively guide the die base 10 therealong. The die base 10 defines an axial screw hole in its center. The adjusting screw 30 comprises a contact end 301 and a mounted end 302 opposite to the contact end 301. A latching portion 303 is configured between the contact end 301 and the mounted end 302. A slot 304 is defined between the contact end 301 and the latching portion 303. The mounted end 302 is received in the sleeve 20 from the first end 205 and connected to the die base 10 via screws. The die base 10 defines at least one hole 101. At least one pin 110 with one end screwed in the hole 101 and the other end received in the second guiding hole 202 limits the rotation of the die base 10 relative to the sleeve 20.

A latching block 50 is disposed around the adjusting screw 30 and configured for engaging with the latching portion 303 to latch the adjusting screw 30. The latching block 50 defines at least one first positioning hole 501. The pull portion 40 is movable along the first guiding hole 201 together with the latching block 50. In this embodiment, the pull portion 40 disposed around the sleeve 20 is annular and aligned with the first guided hole 201. The pull portion 40 defines at least one second positioning hole 401. The latching block 50 is fixed to the pull portion 40 via at least one pin 510 passing through the first guided hole(s) 201 and with two ends respectively fixed in the second positioning hole(s) 401 and the first positioning hole(s) 501. The latching portion 303 comprises an equilateral polygonal periphery and the latching block 50 comprises an equilateral polygonal inner wall, engaging with each other in a clearance fit.

A spring 60 is disposed around the adjusting screw 30, with two ends respectively abutting against the latching block 50 and the stage 203 of the sleeve 20.

A fixing ring 70 is disposed around the adjusting screw 30 with a clearance fit between the contact end 301 and the slot 304. The fixing ring 70 defines at least one second fixing hole 701 extending along a radial direction in the periphery thereof. The fixing ring 70 is fixed on the sleeve 20 via at least one pin 710 with two ends respectively fixed in the first fixing hole(s) 204 of the sleeve 20 and the second fixing hole(s) 701 of the fixing ring 70.

A stop member 80 is fixed on the adjusting screw 30 and neighbors the fixing ring 70. The stop member 80 prevents axial movement of the adjusting screw 30 relative to the sleeve 20. In this embodiment, the stop member 80 is a circular clip latching in the slot 304, limiting axial movement of the fixing ring 70 relative to the adjusting screw 30.

Figure 4:
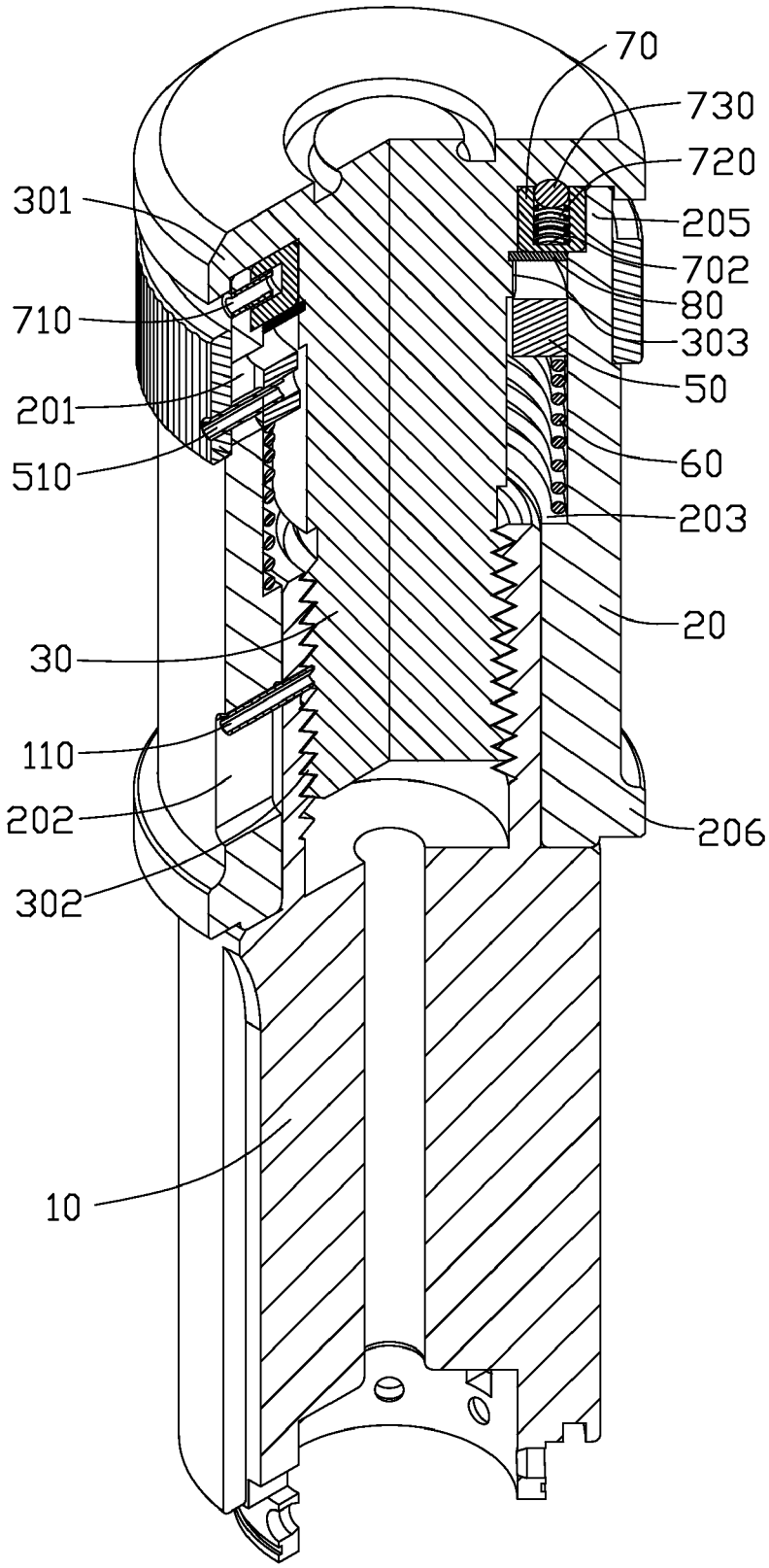
FIG. 4 is a cutaway view along an axis of the punch assembly in an adjusted state of FIG. 1.

Referring to FIG. 4, when the pull portion 40 is moved toward the die base 10, the punch assembly is in an adjusted state when the latching block 50 moves away from the latching portion 303 and the spring 60 is compressed. Rotating the contact end 301 of the adjusting screw 30, the level of the die base 10 of the punch assembly is adjusted by the die base 10 moving along an axis of the sleeve 20. Adjustment of the level of the die base 10 of the punch assembly requires no tools, which is both convenient and efficient. The punch assembly is fixed on a punch press (not shown) with the end surface of the second end 206 maintaining a distance from the hammer (not shown) of the punch press (not shown). Therefore, the distance between the punch assembly and the hammer (not shown) cannot be changed by adjusting the level of the die base 10 of the punch assembly.

Referring to FIG. 3, when the operator releases the pull portion 40, the latching block 50 moves toward the latching portion 303 due to the elasticity of the spring 60. The punch assembly is in a latching state by the latching block 50 engaged with the latching portion 303.

In this embodiment, the contact end 301 of the adjusting screw 30 defines a plurality of recesses 3011 evenly located in a lower surface thereof, wherein the lower surface is contiguous with the fixing ring 70. The fixing ring 70 defines at least one blind hole 702, each of which receives a resilient element such as a spring 720 therein. Each recess 3011 is adapted for receiving a ball 730 therein. The spring 720 secures the ball 730 into one of the recesses 3011 and when the contact end 301 is rotated, the ball 730 moves from one recess 3011 to a neighboring one. As a result, precision settings can be detected after the punch assembly has been adjusted. The length of the adjusted punch assembly exhibits improved precision, convenience, and efficiency.

Figure 5:
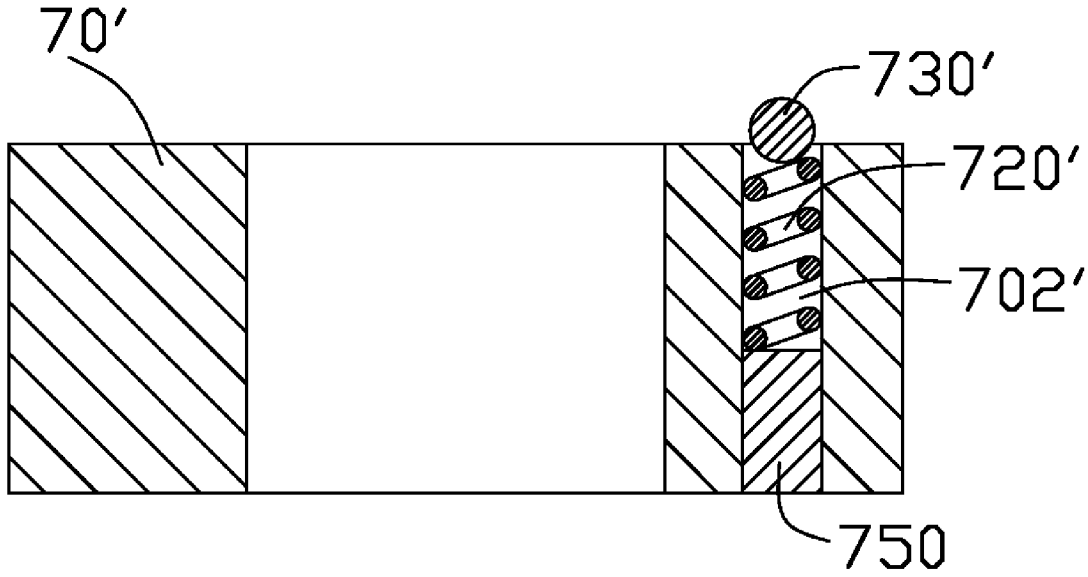
FIG. 5 is a cutaway view along an axis of a fixing ring of a punch assembly in accordance with another exemplary embodiment.

Referring to FIG. 5, in another embodiment, the fixing ring 70' defines at least one through hole 702', with at least one screw 750 mounted into one end thereof. Each of the through hole(s) 702' receives a spring 720' as a resilient element from another end, the recesses 3011 are adapted for receiving a ball 730' therein, and the spring 720' secures the ball 730' into one of the recesses 3011. The resilience of the spring 720' can be adjusted by rotation of screw 750.

Figure 6A:
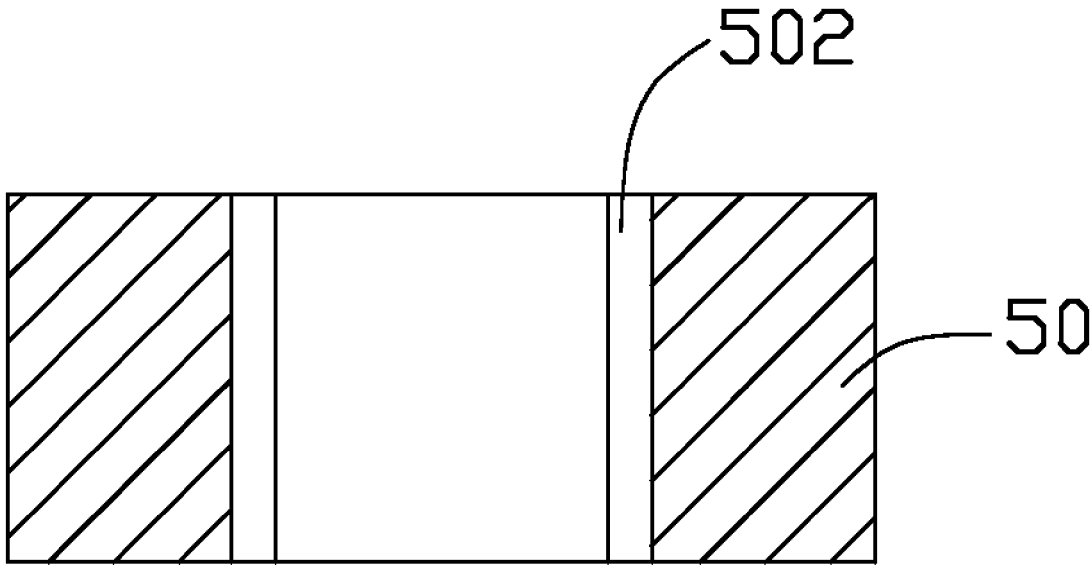
FIG. 6*a* is a cutaway view along an axis of a latching block of a punch assembly in accordance with another exemplary embodiment.
Figure 6B:
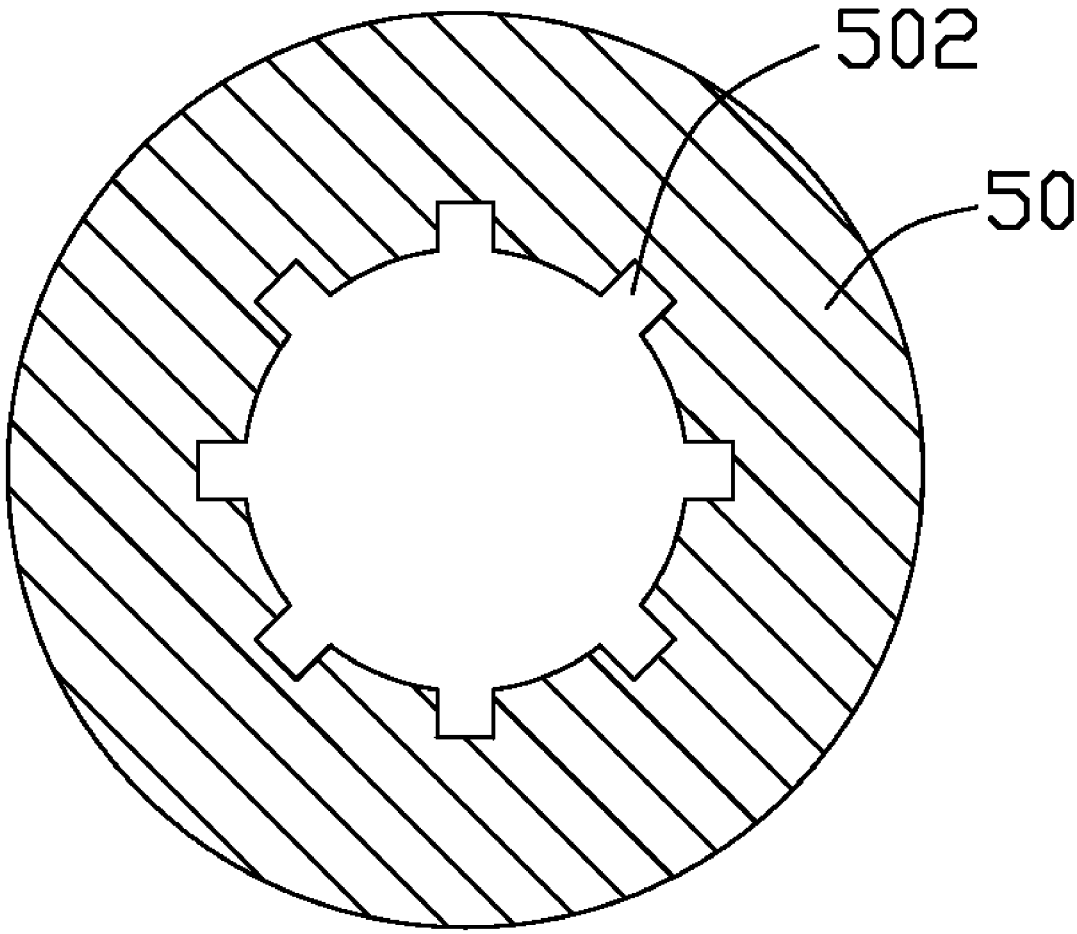
FIG. 6*b* is a cross-section of a latching portion matching the latching block of FIG. 6*a;*
Figure 6C:
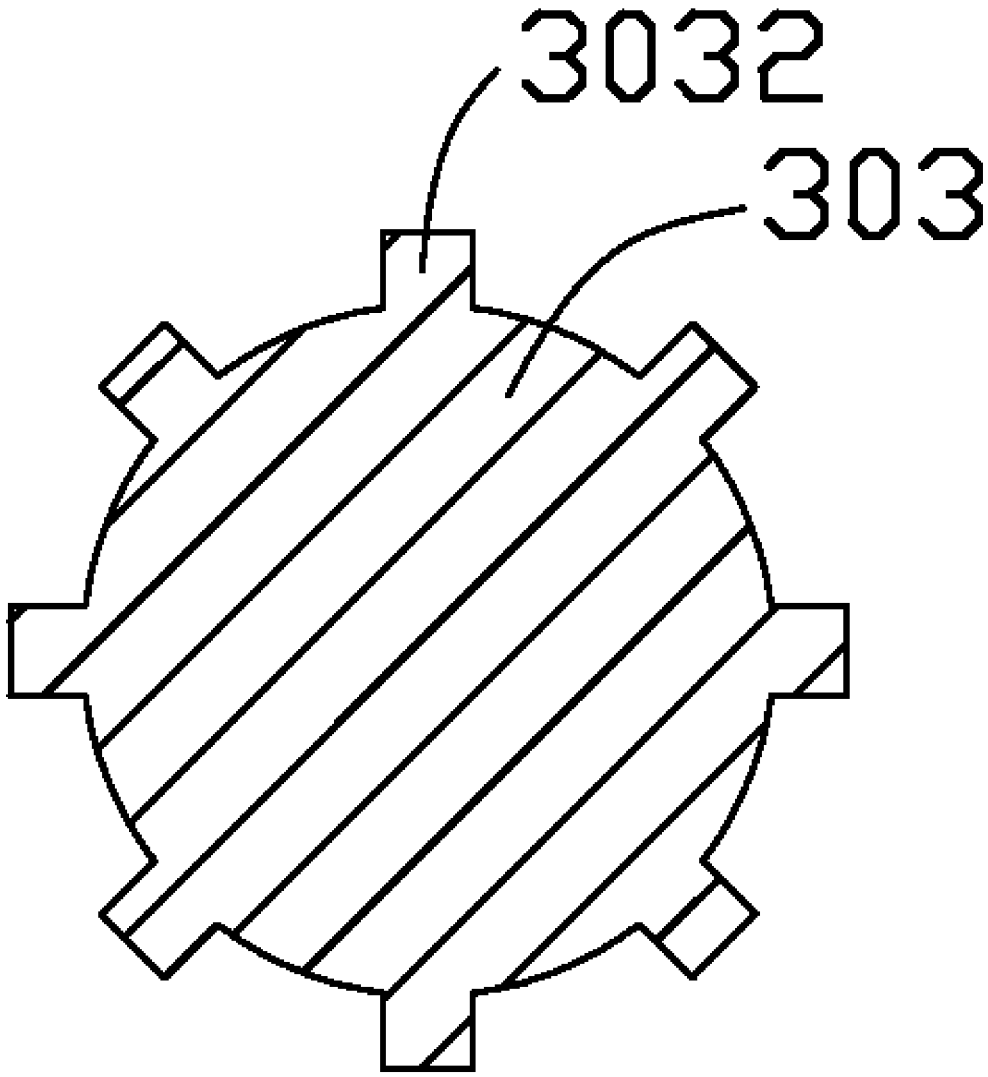
FIG. 6*c* is a cross-section of a latching portion matching the latching block of FIG. 6*a.*

Referring to FIG. 6*a*, FIG. 6*b* and FIG. 6*c*, in another embodiment, the latching block 50 defines a plurality of grooves 502 evenly located in the inner wall thereof. The latching portion 303 comprises a plurality of protrusions 3032 evenly located on the outer wall thereof, wherein the protrusions 3032 are received in the grooves 502 to latch to the punch assembly.

Figure 7A:
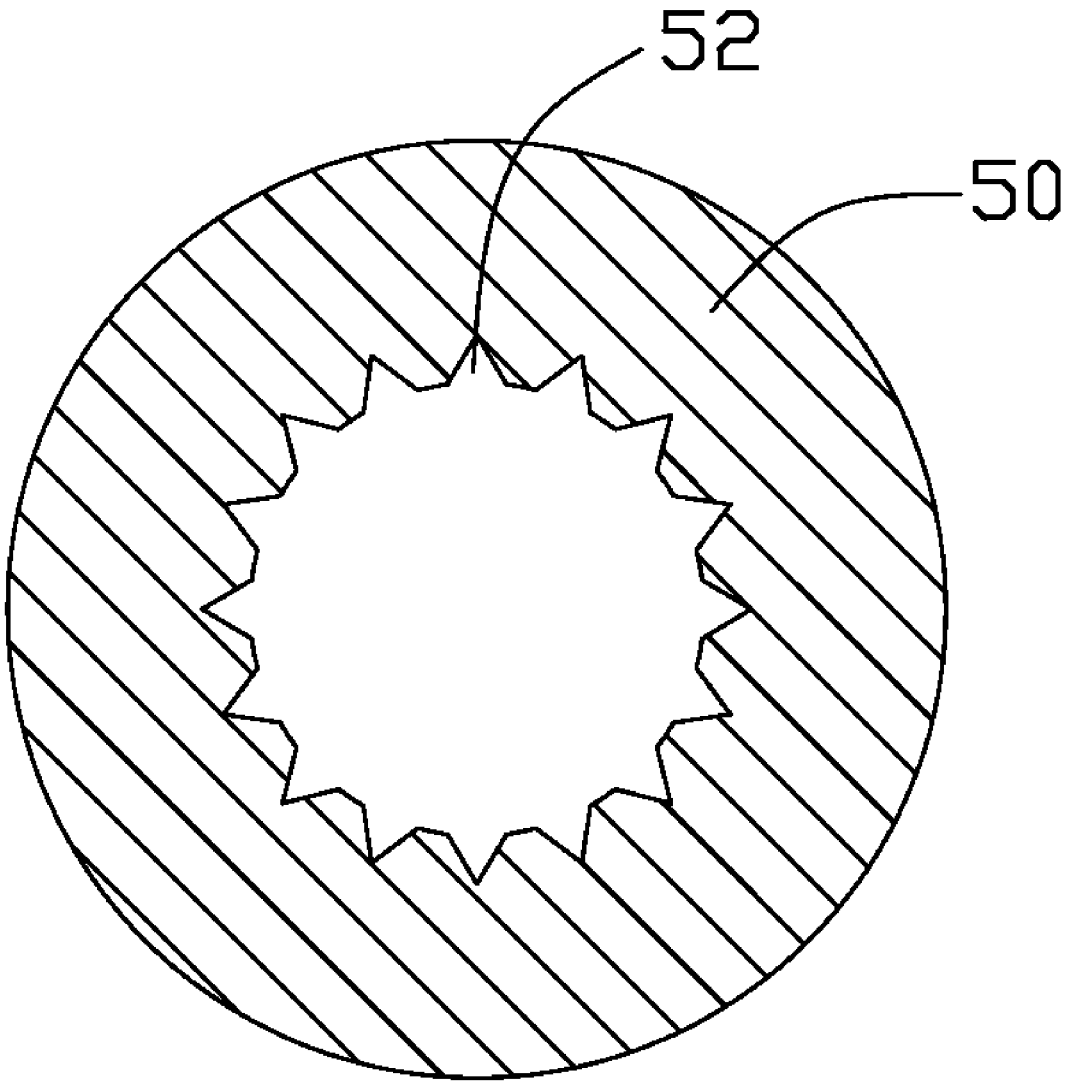
FIG. 7*a* is a cross-section of a latching block of a punch assembly in accordance with another exemplary embodiment.
Figure 7B:
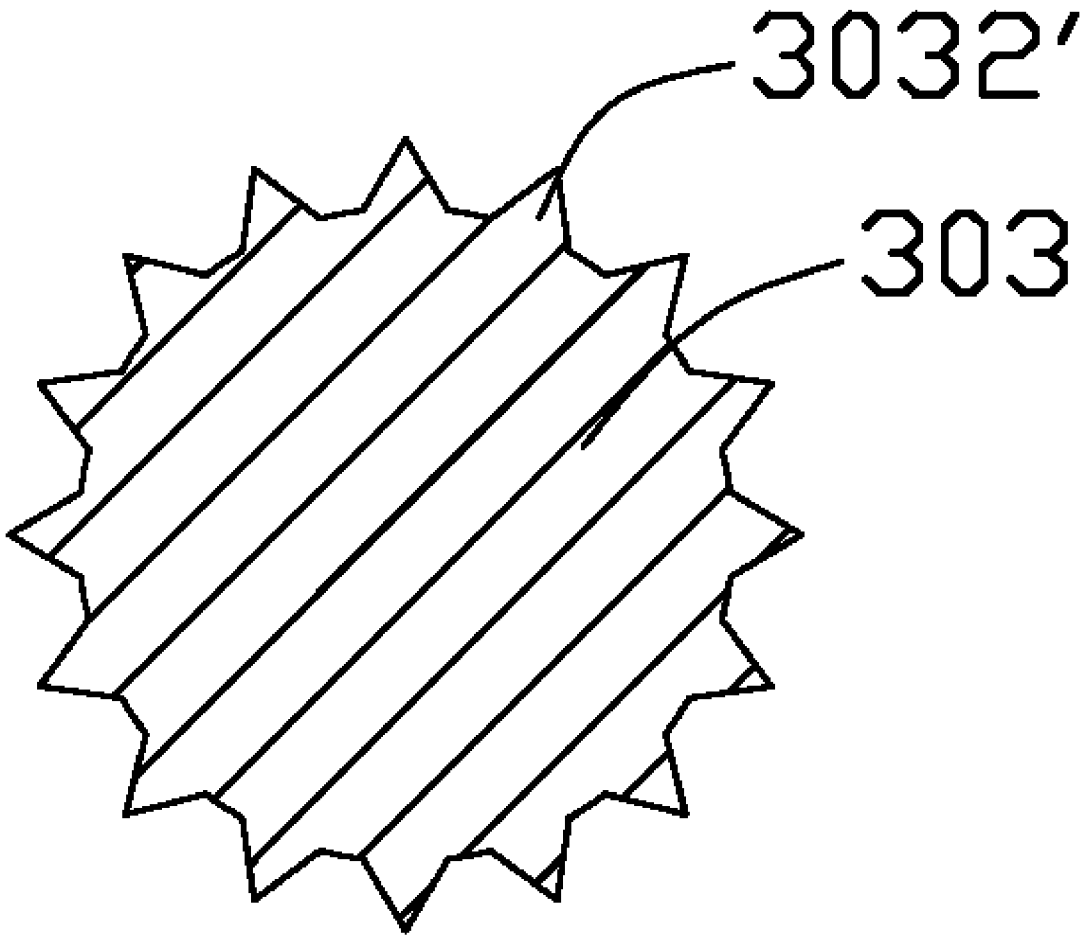
FIG. 7*b* is a cross-section of a latching portion matching the latching block of FIG. 7*a.*

Referring to FIG. 7*a*, and FIG. 7*b*, in another embodiment, the latching block 50 comprises a plurality of teeth 52 evenly located in the inner wall thereof and the latching portion 303 comprises a plurality of teeth 3032' evenly located in the outer wall thereof. The teeth 52 engage with the teeth 3032' to latch the punch assembly.

While exemplary embodiments have been described above, it should be understood that they have been presented by way of example only and not by way of limitation. Thus, the breadth and scope of the present invention should not be limited by the above-described exemplary embodiments, but should be defined only in accordance with the following claims and their equivalents.

What is claimed is:

1. A punching assembly, comprising:

a die base, comprising at least one pin thereon; and a base adjusting device for adjusting a base level of the die base, comprising:

a sleeve comprising a first end defining at least one first guiding hole, a second end defining at least one second guiding hole and a stage on an inner wall thereof, the die base partially received in the sleeve, the pin and the at least one second guiding hole cooperatively guiding the die base movable along the second guiding hole;

an adjusting screw comprising a contact end and a mounted end received in the sleeve from the first end and connected to the die base via screws, and a latching portion configured between the contact end and the mounted end;

a latching block disposed around the adjusting screw and adapted for engaging with the latching portion;

a pull portion fixed to the latching block through the first guiding hole, and movable along the first guiding hole together with the latching block;

an elastic element disposed around the adjusting screw with two ends respectively abutting against the latching block and the stage;

a fixing ring fixed on the sleeve and disposed around the adjusting screw, and contiguous with the contact end in a clearance fit; and a stop member fixed on the adjusting screw and contiguous with the fixing ring for preventing axial movements of the adjusting screw relative to the sleeve.

2. The punching assembly as claimed in claim 1, wherein the stop member is a circular clip latching in a slot defined in the adjusting screw for limiting axial movement of the fixing ring relative to the adjusting screw.

3. The punching assembly as claimed in claim 1, wherein the latching portion comprises an equilateral polygonal periphery and the latching block comprises an equilateral polygonal inner wall, both of which engage in a clearance fit.

4. The punching assembly as claimed in claim 1, wherein the latching portion comprises an inner wall defining a plurality of grooves and the latching block comprises an outer wall comprising a plurality of protrusions, both of which engage in a clearance fit.

5. The punching assembly as claimed in claim 1, wherein the latching block and the latching portion respectively comprise an inner wall and an outer wall, with both comprising a plurality of teeth evenly located thereon, wherein the plurality of teeth engage with each other in a clearance fit.

6. The punching assembly as claimed in claim 1, wherein the fixing ring defines at least one blind hole receiving a corresponding resilient element therein, the contact end defines a plurality of recess adapted for receiving a ball therein, and the resilient element secures the ball in one of the recesses.

7. The punching assembly as claimed in claim 6, wherein the recesses are evenly located around the contact end.

8. The punching assembly as claimed in claim 1, wherein the fixing ring defines at least one through hole with one end blocked by a screw, each of the at least one through holes receives a resilient element from another end, the contact end defines a plurality of recesses adapted for receiving a ball therein, and the resilient element secures the ball into one of the recesses.

9. The punching assembly as claimed in claim 8, wherein the recesses are evenly located around the contact end.

10. The punching assembly as claimed in claim 1, wherein the outer diameter of the second end of the sleeve exceeds the maximum diameter of the die base.

11. The punching assembly as claimed in claim 1, further comprising at least one pin with one end fixed on the die base and the other end received in the second guiding hole for limiting rotation of the die base relative to the sleeve.

12. The punching assembly as claimed in claim 1, wherein the pull portion is a ring and disposed around the sleeve.

13. A base adjusting device of a punching assembly connecting with a die base comprising at least one pin thereon, comprising:

a sleeve comprising a first end defining at least one first guiding hole, a second end defining at least one second guiding hole and a stage on an inner wall thereof, wherein the die base is partially received in the sleeve, and the pin and the at least one second guiding hole cooperatively guide the die base movably along the second guiding hole;

an adjusting screw comprising a contact end and a mounted end received in the sleeve from the first end and connected to the die base via screws, and a latching portion configured between the contact end and the mounted end;

a latching block disposed around the adjusting screw and adapted for engaging with the latching portion;

a pull portion fixed to the latching block through the first guiding hole, and movable along the first guiding hole together with the latching block;

an elastic element disposed around the adjusting screw with two ends respectively abutting against the latching block and the stage;

a fixing ring fixed on the sleeve and disposed around the adjusting screw, and contiguous with the contact end in a clearance fit; and a stop member fixed on the adjusting screw and contiguous with the fixing ring for preventing axial movements of the adjusting screw relative to the sleeve.

14. The base adjusting device as claimed in claim 13, wherein the latching portion comprises an equilateral polygonal periphery and the latching block comprises an equilateral polygonal inner wall, both of which engage in a clearance fit.

15. The base adjusting device as claimed in claim 13, wherein the latching portion comprises an inner wall defining a plurality of grooves and the latching block comprises an outer wall comprising a plurality of protrusions, both of which engage in a clearance fit.

16. The base adjusting device as claimed in claim 13, wherein the latching block and the latching portion respectively comprise an inner wall and an outer wall, both the inner wall and the outer wall comprise a plurality of teeth evenly located thereon that engage with each other in a clearance fit.

17. The base adjusting device as claimed in claim 13, wherein the fixing ring defines at least one blind hole receiving a corresponding resilient element therein, the contact end defines a plurality of recesses adapted for receiving a ball therein, and the resilient element secures the ball in one of the recesses.

18. The base adjusting device as claimed in claim 13, wherein the fixing ring defines at least one through hole with one end blocked by a screw, each of the at least one through holes receives a resilient element from another end, the contact end defines a plurality of recesses adapted for receiving a ball therein, and the resilient element secures the ball into one of the recesses.

* * * * *